United States Patent [19]

Klingenberg

[11] 4,080,781

[45] Mar. 28, 1978

[54] ELECTRONIC WRIST WATCH

[76] Inventor: Hans Ulrich Klingenberg, 3274 St. Niklaus near Merzligen, Bern, Switzerland

[21] Appl. No.: 689,836

[22] Filed: May 25, 1976

[30] Foreign Application Priority Data

Jun. 4, 1975 Switzerland ..... 7183/75

[51] Int. Cl.[2] ..... G04C 3/00; G04B 37/00; B44C 1/04

[52] U.S. Cl. ..... 58/90 R; 58/23 R; 58/55 R; 206/18; 350/67

[58] Field of Search ..... 58/23 R, 53, 55, 88, 58/90 R; 206/18; 350/61, 63, 65, 67

[56] References Cited

U.S. PATENT DOCUMENTS

| | | | |
|---|---|---|---|
| 1,474,816 | 11/1923 | Day | 58/50 A |
| 3,540,208 | 11/1970 | Knock | 58/59 X |
| 3,672,155 | 6/1972 | Bergey et al. | 58/85.5 X |
| 3,744,327 | 7/1973 | Hetzel | 58/23 TF |
| 3,792,578 | 2/1974 | Hetzel | 58/55 |

OTHER PUBLICATIONS

160 USPQ In re Clinton Watch Co., p. 555, Jan.-Mar. 1969.

*Primary Examiner*—E. S. Jackmon
*Attorney, Agent, or Firm*—Stevens, Davis, Miller & Mosher

[57] ABSTRACT

An electronic wrist watch is provided in which an interior space contacting an electronic module is filled with a module protecting liquid. Means are provided for varying the volume of the interior space in accordance with the expansion or contraction of the liquid.

8 Claims, 2 Drawing Figures

ELECTRONIC WRIST WATCH

Figure 1:
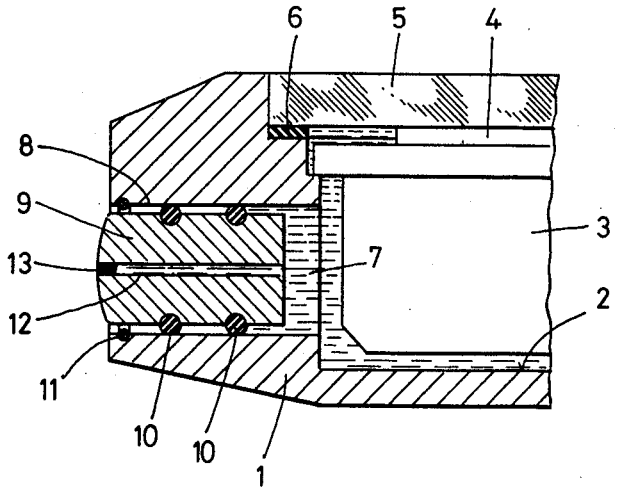

This invention relates to an electronic wrist watch comprising a watchcase having an interior space and at least one rigid portion, a static electronic module, and a static display device integral with the module, the module and the display device being secured within the interior space, and the watchcase being fluidtightly closed.

Mechanical or electrical wrist watches are already known in which the enclosure containing the movement is evacuated or filled with a gas other than air, and these designs are known to present certain advantages as compared with conventional watches in which the movement is surrounded by air.

On the other hand, the evolution of technology in the art of electronic watchmaking has reached a point where it is possible to produce modules and display devices which are completely static, i.e., having no moving parts. The time base of these electronic modules generally comprises a quartz crystal which oscillates in a vacuum within a sealed capsule. However, other completely static time-base systems suitable for controlling the operation of electronic wrist watches are also conceivable. As for the display device, it comprises a rigid panel in which the indication of the time appears through the energizing of lightemitting sources or liquid crystal cells. One of the difficulties encountered in producing such watches has to do with their reliability over long periods of use. The case must be perfectly fluid-tight in order to prevent the entrance of water or moisture which would be liable to oxidize the circuit elements of the module. Even when the case is completely fluid-tight, a certain amount of moisture is introduced within the space containing the module at the time of assembly, and after some time, this moisture may corrode the contacts. In order to ensure the reliability of the module, it must also be protected against shocks and vibrations.

It would not have been possible to protect the metallic elements of mechanical watch movements by placing these movements in a liquid because of the disturbances which this environment would have caused in the running of the movement.

In electronic modules, certain metallic elements, e.g., those intended to form contacts, can scarcely be coated with a layer of nickel in view of the poor electrical characteristics of that metal. Thus the problem of protecting such elements against oxidation is an acute one.

Swiss Pat. No. 538,143 discloses a mechanism which forms part of an electronic timepiece and which is housed within a completely closed case containing a liquid. This case is provided with means allowing the liquid to expand in the event of a variation in temperature. Generally speaking, when a nondeformable enclosure is contains a liquid, it is customary not to fill it up completely but to leave a bubble of air or gas capable of forming a buffer to compensate for variations in volume due to temperature fluctuations. However, this method is not applicable to an enclosure comprising a window through which an indication formed on the device housed within the enclosure is supposed to be easily readable. The reason being, of course, that the bubble would interfere with viewing.

It is an object of this invention to provide an electronic wrist watch of the type initially defined in which the foregoing difficulties are eliminated.

To this end, the electronic wrist watch according to the present invention further comprises a module-protecting liquid completely filling the interior space of the watchcase, and means for varying the volume of that interior space, whereby the liquid is enabled to expand and contract as a function of the temperature.

Figure 2:
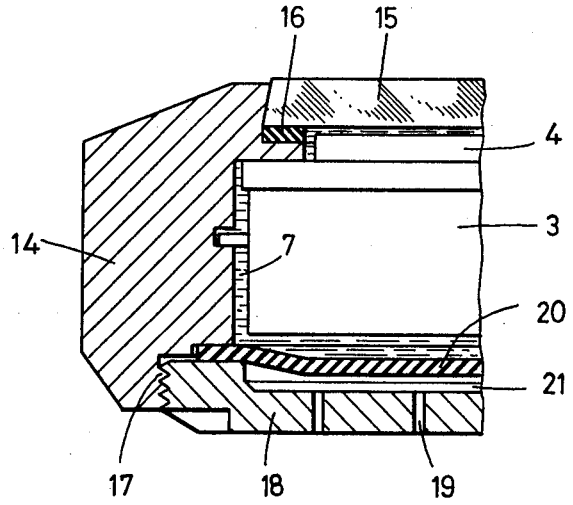

Preferred embodiments of the invention will now be described in detail with reference to the accompanying drawing, in which FIGS. 1 and 2 are partially diagrammatic sectional views of two respective embodiments of the invention.

FIG. 1 illustrates how the invention may be carried out when a watchcase having an integral back is used. This watchcase comprises a case body 1 which may be made of any metallic, organic, or non-metallic inorganic material, such as an oxide or a mixture of oxides amalgamated by sintering. A cavity 2 made within the case body 1 for receiving an electronic module 3 opens into the upper face of the case body 1, which is covered by a mineral glass 5. The module 3 comprises a cell (not shown) and a static display panel 4. The module 3 may be secured within the case by pressure of the edges of the panel 4 against the glass 5, which is fixed at the mouth of the cavity 2 by means of frictional engagement or by cementing, for example. A gasket 6 ensures fluid-tightness between the glass 5 and the case body 1 and hermetically seals the interior space defined by the surface of the cavity 2 and by the glass 5. In accordance with the invention, this interior space is completely filled with a liquid 7 protecting the electronic elements of the module 3 and of the panel 4 against oxidation, as well as against shocks. The liquid 7 should satisfy the following requirements:

(a) It should be chemically stable within the entire range of temperatures to which the watch will be exposed.

(b) It should be transparent; in certain embodiments, however, a tinted liquid might be used.

(c) It should be inert with respect to the materials with which it comes in contact, particularly to avoid any oxidation or other chemical reaction with the conductors comprised in the module, as well as with the walls of the watchcase and the module support.

(d) It should be as near perfect an insulating agent as possible; moreover, it will be advisable to use a liquid having low viscosity and high surface tension.

Preferably, the liquid 7 will have a thermal expansion coefficient of the same order as that of the case. It might even be solidifiable, at least temporarily, after casing, either by polymerization or by change of temperature.

Despite the many different requirements which the liquid 7 must satisfy, there are a number of known liquids which may be used for the purpose described here. Research has indeed shown that certain silicones, as well as certain members of the paraffin series, fulfill the set requirements to a satisfactory extent. As indicated above, the presence of a dye within the liquid 7 will have the effect of giving a particular tint to the display panel 4 which will be visible beneath the glass 5 through a thin layer of the liquid 7 described.

In order to compensate for variations in the volume of the liquid 7 in the event of considerable temperature fluctuations, the case body 1 has a cylindrical radial opening 8 in one of its sidewalls, within which opening is a cylindrical element 9 acting as a piston and sliding within the opening 8. Fluid-tightness between the piston element 9 and the inside surface of the opening 8 is ensured by two O-rings 10 seated in grooves of semicircular profile in the lateral face of the piston element 9. A stop-collar 11 prevents the piston element 9 from sliding towards the outside beyond a certain limit. It will also be noted that the piston element 9 is pierced by a central channel 12, the outer end of which is closed by stopping means 13. The channel 12 acts as a valve during casing, allowing excess liquid to be evacuated when the glass 5 is set in place. The channel 12 is stopped by means of a plug or by fusion once the watch is completely cased up. The piston element 9 may be made of plastic or of some other material. In the latter case, it may be provided with a plastic insert at the outer end of the channel 12.

In the embodiment illustrated in FIG. 2, the module 3 with its display panel 4 is housed within a two-piece watchcase comprising a caseband 14 bearing a glass 15 and a back 18. Fluid-tightness of the joint between the caseband 14 and the glass 15 is ensured by a gasket 16. The glass 15 and the opening of the caseband 14 will be about the same size and shape as the panel 4 on which the time indications produced by the module 3 are displayed. The caseband 14 is a conventionally designed part having a threaded opening 17 at the bottom into which the rim of the back 18 is screwed. The back 18 is provided with a series of small holes 19. Moreover, its rim presses the edge of an elastic diaphragm 20 against a shoulder of the caseband 14. Thus the diaphragm 20 is stretched between the module 3 and the back 18 and, together with the inside surface of the caseband 14 and the glass 15, defines the interior space containing the liquid 7 and the module 3 with its panel 4. Casing will take place at room temperature, and care should be taken to leave a slight space 21 between the diaphragm 20 and the back 18 in order to allow the diaphragm 20 room to press elastically against the inner surface of the back 18 in the event of a significant increase in temperature.

In order to achieve the arrangement depicted in FIG. 2, a thin block of paraffin, solid at the ambient temperature, might, for example, be placed between the back 18 and the diaphragm 20 at the time of casing. When the watch is tested as to its performance at high temperatures, the paraffin will melt and flow out through the holes 19 owing to distention of the diaphragm 20. Upon subsequent cooling, the space 21 will fill up with air so as to allow distention again if the temperature should once more rise above normal.

Furthermore, it will be noted that instead of having the edge of the diaphragm 20 act as a gasket, this diaphragm might form part of a completely closed envelope containing the liquid 7, the module 3, and the display device 4. At the time of casing, it would suffice to place this envelope within the caseband 14, thus considerably facilitating assembly of the watch.

Still other means may be envisaged for preventing an increase in internal pressure upon thermal expansion of the liquid. Thus, for example, the upper and lower walls of the watchcase might be semi-rigid plastic elements capable of bulging and flattening as a function of the temperature. Inasmuch as the interior space defined by these elements is normally a very flat space, it is not necessary for the walls to undergo any considerably lengthening in order to realize the required increase in inner volume, say about 5%. It suffices for the upper and lower walls to be able to bulge somewhat, thus changing the shape of the watchcase. Thus, without any extension of the material, the volume of the interior space of the watchcase may be increased by causing the shape of the watchcase to approach the shape enclosing the maximum volume, which is, of course, the spherical shape.

Finally, the present invention might also be carried out by mounting the glass on the caseband, or on a case having an integral back, in such a way that the glass can move slightly parallel to itself in order to increase or decrease the interior space as a function of temperature fluctuations.

What is claimed is:

1. An electronic wrist watch comprising a watch case defining a portion of the exterior surface of said wrist watch and containing an interior space and at least one rigid portion, a static electronic module integral with a static display device secured within said interior space, means for closing said interior space in a fluid-tight manner, said means for closing including a structure defining another portion of the exterior surface of said wrist watch, module protecting liquid completely filling the remaining interior space not occupied by said electronic module and display device, and means responsive to the expansion and contraction of said protecting liquid for varying the volume of said interior space.

2. An electronic wrist watch in accordance with claim 1, wherein said watchcase comprises a plurality of rigid portions, one of said portions having an opening therein and another of said portions being mounted for sliding in a fluid-tight manner within said opening.

3. An electronic wrist watch in accordance with claim 2, further comprising two or more gaskets engaged within said opening, said portion mounted for sliding being borne by said gaskets.

4. An electronic wrist watch in accordance with claim 2, wherein said portion mounted for sliding includes at least one channel passing completely therethrough and functions as a valve body, said channel being stopped when said watchcase is closed.

5. An electronic wrist watch in accordance with claim 1, wherein said means for varying the volume comprises an elastically deformable diaphragm limiting said interior space on at least one side.

6. An electronic wrist watch in accordance with claim 5, wherein said deformable diaphragm forms part of a completely closed deformable envelope containing said module and said liquid, the remainder of said envelope resting against the inner surfaces of said rigid portion or portions.

7. An electronic wrist watch in accordance with claim 5, wherein said diaphragm is fixed by its edge in a fluid-tight manner to a said rigid portion of said watchcase.

8. An electronic wrist watch in accordance with claim 7, wherein said watchcase comprises as said rigid portions a caseband, a glass fitted on said caseband, and a back detachably secured to said caseband and having a plurality of holes therein and a rim, said edge of said diaphragm being gripped between said rim and said caseband to form a gasket, and said holes allowing air to enter between said back and said diaphragm.

* * * * *